US009032918B2

(12) United States Patent
Mikalsen et al.

(10) Patent No.: US 9,032,918 B2
(45) Date of Patent: May 19, 2015

(54) FREE-PISTON INTERNAL COMBUSTION ENGINE

(75) Inventors: Rikard Mikalsen, Hamburg (DE); Anthony Paul Roskilly, Longhorsley (GB)

(73) Assignee: University of Newcastle upon Tyne, Newcastle upon Tyne (GB)

( * ) Notice: Subject to any disclaimer, the term of this patent is extended or adjusted under 35 U.S.C. 154(b) by 72 days.

(21) Appl. No.: 13/698,569

(22) PCT Filed: May 16, 2011

(86) PCT No.: PCT/GB2011/050931

§ 371 (c)(1), (2), (4) Date: Jan. 25, 2013

(87) PCT Pub. No.: WO2011/144926

PCT Pub. Date: Nov. 24, 2011

(65) Prior Publication Data

US 2013/0118453 A1 May 16, 2013

(30) Foreign Application Priority Data

May 19, 2010 (GB) ..... 1008319.4

(51) Int. Cl.
*F02B 71/00* (2006.01)
*F02B 75/16* (2006.01)
(Continued)

(52) U.S. Cl.
CPC ..... *F02B 71/00* (2013.01); *F01B 11/004* (2013.01); *F02B 33/06* (2013.01); *F02B 63/041* (2013.01)

(58) Field of Classification Search
CPC .... F02B 71/00; F02B 71/04; F02B 2075/025; F02B 2075/027; F02B 71/045; F02B 75/04; F02B 75/002; F02B 1/04; F02B 25/00; F02B 33/14; F02B 3/06; F01L 1/12; F02D 13/0215; F02D 13/0261
USPC ..... 123/46 R, 62, 63, 311, 46 E
See application file for complete search history.

(56) References Cited

U.S. PATENT DOCUMENTS 848,029 A 3/1907 Haselwander
1,062,999 A 5/1913 Webb
(Continued)

FOREIGN PATENT DOCUMENTS

DE 21 42 458 A1 3/1973
DE 34 35 356 A1 9/1984
(Continued)

OTHER PUBLICATIONS

PCT International Search Report and Written Opinion under date of mailing of Aug. 8, 2011 in connection with PCT/GB2011/050931, 11 pages.
(Continued)

*Primary Examiner* — Lindsay Low
*Assistant Examiner* — Syed O Hasan
(74) *Attorney, Agent, or Firm* — Quarles & Brady LLP

(57) ABSTRACT

A linear-acting, free-piston internal combustion engine suitable for operation on a four-stroke engine cycle comprises a power piston (11*a*, 11*b*) reciprocating in a power chamber (18*a*, 18*b*) and a compression piston (23, 23*a*, 23*b*) reciprocating in a compression chamber (29*a*, 29*b*). The power piston (11*a*, 11*b*) and the compression piston (23, 23*a*, 23*b*) are rigidly connected by means of a rod (19). The compression piston (23, 23*a*, 23*b*) performs alternately an intake stroke and a compression stroke and the power piston (11*a*, 11*b*) performs alternately a power stroke and an exhaust stroke.

19 Claims, 3 Drawing Sheets

(51) Int. Cl.

| | |
|---|---|
| ***F02B 33/06*** | (2006.01) |
| ***F02B 75/02*** | (2006.01) |
| ***F01B 11/00*** | (2006.01) |
| *F02B 63/04* | (2006.01) |

(56) References Cited

U.S. PATENT DOCUMENTS

| | | | | | |
|---|---|---|---|---|---|
| 2,963,008 | A | * | 12/1960 | Waldrop | 123/46 A |
| 3,188,805 | A | | 6/1965 | Gahagan | |
| 3,269,321 | A | | 8/1966 | Eickmann | |
| 4,385,597 | A | * | 5/1983 | Stelzer | 123/62 |
| 4,414,927 | A | * | 11/1983 | Simon | 123/62 |
| 4,924,956 | A | | 5/1990 | Deng et al. | |
| 7,845,317 | B2 | * | 12/2010 | Max et al. | 123/46 E |
| 2002/0092485 | A1 | | 7/2002 | Alexius et al. | |
| 2007/0209615 | A1 | | 9/2007 | Epshteyn | |
| 2009/0179424 | A1 | | 7/2009 | Yaron | |

FOREIGN PATENT DOCUMENTS

| | | | |
|---|---|---|---|
| DE | 39 05 383 | A1 | 6/1990 |
| DE | 44 47 040 | C1 | 12/1994 |
| DE | 197 38 375 | A1 | 9/1997 |
| EP | 0 810 356 | A1 | 12/1997 |
| GB | 2 081 379 | A | 8/1980 |
| JP | H06288253 | A | 10/1994 |
| JP | 2005520964 | A | 7/2005 |
| JP | 2009002349 | A | 1/2009 |
| WO | 93/09340 | A1 | 5/1993 |
| WO | 97/34079 | A1 | 9/1997 |
| WO | 00/61929 | A1 | 10/2000 |
| WO | 2009/079698 | A1 | 7/2009 |
| WO | 2010/116172 | A1 | 10/2010 |

OTHER PUBLICATIONS

Search Repot under date of Jan. 5, 2011 in connection with GB Application 1008319.4, 7 pages.

* cited by examiner

FREE-PISTON INTERNAL COMBUSTION ENGINE

CROSS-REFERENCE TO RELATED APPLICATIONS

This application represents the national stage entry of PCT International Application No. PCT/GB2011/050931 filed on May 16, 2011 and claims the benefit of Great Britain Patent Application No. 1008319.4 filed May 19, 2010. The contents of both of these applications are hereby incorporated by reference as if set forth in their entirety herein.

FIELD OF THE INVENTION

The present invention relates to a free-piston internal combustion engine, in particular a free-piston internal combustion engine which permits four-stroke cycle-like operation.

BACKGROUND OF THE INVENTION

Free-piston internal combustion engines are linear engines in which the need for a crankshaft system is eliminated and the power piston (or pistons) and associated components have a purely linear motion. FIG. 1 illustrates the configuration of a dual-piston free-piston engine system known from the prior art. The engine includes two opposing combustion cylinders, each being similar to those known from conventional two-stroke cycle crankshaft engines. The two combustion cylinder pistons are rigidly connected and form a piston assembly, which is the only significant moving component. The piston assembly can move linearly, the outer limits of the motion being restricted by the combustion cylinders. Two-stroke cycle operation in each cylinder maintains a reciprocating motion of the piston assembly. A power stroke is performed alternately by each of the two pistons, such that a power stroke in one cylinder drives the compression stroke in the other cylinder. This eliminates the need for a rebound device, used in a single-piston free-piston engine for storing energy generated in the power stroke for compressing the next cylinder charge. Incorporated into the system is a linear electric machine, with a translator (usually comprising permanent magnets) fixed to the piston assembly and a stator (comprising coils) fixed to the engine housing, allowing conversion of additional surplus energy into electric energy.

The potential advantages of free-piston engine systems compared to conventional, crankshaft engines are numerous. The simplicity of the engine and reduced number of parts compared to a conventional engine reduce frictional losses and wear, as well as engine size, weight, and manufacturing costs. The absence of bearings carrying high loads, such as those found in the crank system in conventional engines, allows operation with high in-cylinder pressures, benefiting fuel efficiency. Moreover, the compression ratio in a free-piston engine is variable, which allows extensive operational optimisation for different operating conditions (such as load level), as well as for different fuels.

Examples of publications describing free-piston engine systems include U.S. Pat. No. 2,900,592, U.S. Pat. No. 4,924,956, U.S. Pat. No. 5,002,020, U.S. Pat. No. 6,199,519, and U.S. Pat. No. 6,541,875. An overview of this technology was presented by Mikalsen and Roskilly in *Applied Thermal Engineering,* 2007; 27:2339-2352.

There are two main challenges associated with prior art free-piston engine systems which have prevented their commercial success.

First, the free-piston engine is, in its standard configuration, restricted to the two-stroke operating principle, since a power stroke is required every reciprocation cycle to maintain engine operation. In a conventional crankshaft engine, the energy stored in the crank system and flywheel can drive the piston during the gas exchange strokes of a four-stroke cycle, giving the engine designer a choice between two-stroke and four-stroke operation. In the free-piston engine, no such energy storage exists. It is well known that small to medium size two-stroke cycle engines suffer from poor fuel efficiency and high exhaust gas emissions compared to four-stroke engines, and it is therefore currently used only in a limited number of applications. The main reason for the poorer performance is the inefficient gas exchange process in two-stroke engines. Scavenging of the cylinder is achieved by the simultaneous opening of inlet and exhaust ports while the piston is in the lower part of the cylinder (around bottom dead centre). Achieving efficient scavenging, in which all combustion products are displaced by fresh charge, is extremely challenging, and typically only a replacement of 60-80 percent of the combustion products from a previous cycle can be achieved. Furthermore, since the inlet ports and exhaust ports (or valves) necessarily must be open simultaneously, there will be some flow of inlet charge directly to the exhaust system (known as short-circuiting). This has significant adverse effects on both fuel efficiency and exhaust gas emissions levels.

Some alternative configurations have been proposed to allow four-stroke operation in free-piston-type engines. One example was described in U.S. Pat. No. 7,258,086, which used a four cylinder configuration in which one of the cylinders at any time performed a power stroke. Mechanical linkages were then used to drive the non-power strokes in the other cylinders. However, the additional complexity in these systems removes several of the key advantages of the free-piston engine concept, including compactness, a low number of moving components, and no load-carrying bearings or linkages.

The second fundamental challenge associated with the free-piston engine concept is the control of the piston motion. In a conventional crankshaft engine, the high inertia of the crank system and flywheel stabilises engine operation, in particular during rapid load changes or cycle-to-cycle variations in the combustion process. In the free-piston engine, these will have a significantly larger effect on engine operation. Since the piston motion in a free-piston engine is not restricted by a crankshaft, a sufficiently high kinetic energy of the piston assembly, for example due to a rapid load decrease, may lead to mechanical contact between the piston and cylinder head, which may be catastrophic for the engine. Conversely, a reduction in kinetic energy, for example due to a rapid load increase, may lead to a failure to reach sufficient compression of the in-cylinder charge and the engine stalling.

SUMMARY OF THE INVENTION

According to an aspect of the invention, there is provided a free-piston internal combustion engine comprising:

- a first compression chamber;
- a first compression piston reciprocable in the first compression chamber;
- a first power chamber;
- a first power piston reciprocable in the first power chamber;
- conduit means for conducting fluid from the first compression chamber to the first power chamber; and valve means for controlling the flow of fluid into and out of the first compression chamber and the first power chamber;

wherein the first compression piston and the first power piston are rigidly coupled for reciprocation in unison;

wherein the first compression chamber, first power chamber and valve means are configured such that during each reciprocation cycle of said first compression and power pistons:

the first compression piston performs one intake stroke and one compression stroke of a four-stroke engine cycle, and the first power piston performs one power stroke and one exhaust stroke of the four-stroke engine cycle.

By performing the intake and compression strokes separately from the power and exhaust strokes, the free-piston engine is effectively able to operate on a four-stroke cycle. This provides the advantages of higher fuel efficiency and lower exhaust gas emissions compared with the known two-stroke free-piston engines. At the same time, the engine of the present invention maintains the advantages of a free-piston engine over a conventional crankshaft engine, in particular a compact design, low friction, high controllability and high operational flexibility.

A further advantage of the present invention is that the compression chamber can be designed independently of the power chamber, and can therefore be adapted specifically to its purpose. This is different to conventional systems, in which these functions are provided by the same working chamber. For example, the lower pressure levels in the compression chamber results in comparatively relaxed sealing requirements compared with the power chamber. As there is a trade-off between sealing and frictional losses, the use of different sealing arrangements in the compression chamber and power chamber can reduce overall engine friction. Also, the lower gas temperature in the compression chamber may permit the use of solid film lubrication, eliminating the need for an oil lubrication system for this component. Yet another advantage is that the ratio of the swept volumes of the compression and power chambers need not be unity, and can be designed according to any given application.

Preferably, the free-piston internal combustion engine further comprises:

a second compression chamber a second compression piston reciprocable in the second compression chamber;

a second power chamber; and a second power piston reciprocable in the second power chamber;

wherein the conduit means is further adapted for conducting fluid from the second compression chamber to the second power chamber and/or the first power chamber; and wherein the valve means is further adapted for controlling the flow of fluid into and out of the second compression chamber and the second power chamber;

wherein the second compression piston and the second power piston are rigidly coupled for reciprocation in unison with the first compression piston and the first power piston;

wherein the second compression chamber, second power chamber and valve means are configured such that during each reciprocation cycle of said second compression and power pistons:

the second compression piston performs one compression stroke and one intake stroke of a four-stroke engine cycle, and the second power piston performs one exhaust stroke and one power stroke of the four-stroke engine cycle.

The advantage of providing second power and compression pistons as defined above is that the power stroke by the second power piston can be used to drive the exhaust stroke of the first power piston, obviating the need for a dedicated rebound device.

In one embodiment, the first and second compression chambers are provided in a single compression cylinder, and the first and second compression pistons are provided by a double-acting compression piston reciprocable in said compression cylinder.

In another embodiment, the first power chamber and second compression chamber are provided in a first cylinder, the first power piston and second compression piston being provided by a first double-acting piston reciprocable in the first cylinder; and the second power chamber and first compression chamber are provided in a second cylinder, the second power piston and first compression piston being provided by a second double-acting piston reciprocable in the second cylinder.

The conduit means may be adapted for conducting fluid from the first and second compression chambers to the first and second power chambers.

The conduit means may be further adapted to temporarily store compressed fluid discharged from the first and/or second compression chamber.

By providing conduit means with a sufficiently high volume and fluid storage capability, the pressure variations in the conduit means during discharge from the first and second compression chambers will be minimised. Thereby, the pressure as seen by the valve means controlling the flow of compressed fluid into the first and second power chambers will be substantially constant, benefiting the flow of compressed fluid across these valves and into the power chambers.

The free-piston internal combustion engine may further comprise an electronic controller for controlling said valve means.

Advantageously, electronic control of the valve means provides improved operational control, particularly when used to control the opening and closing times of inlet and exhaust valves of the power chamber.

The electronic controller may be adapted to control an amount of power produced in said power stroke by adjusting an amount of fluid admitted into the power chamber by said valve means.

The amount of fluid admitted into the power chamber by said valve means may be adjusted by adjusting an opening and/or closing time or duration for which the valve means admits fluid into the power chamber. For example, the time for which fluid is admitted into the power chamber may be reduced in order to reduce the energy produced in the next power stroke. On the other hand, the timing of the valve means may be adjusted so that fluid enters the power chamber prior to the power piston reaching its endpoint, in order to increase the energy output of the next power stroke.

The electronic controller may be adapted to adjust the timing of the valve means when an increase in kinetic energy of the compression and power pistons sufficient for them to travel past a predefined end point is present.

Advantageously, this may reduce the risk of mechanical contact between the piston and cylinder head. The valve means may be controlled to advance the closing of exhaust valve means allowing fluid out of the power chamber and/or to delay the opening of inlet valve means allowing fluid into the power chamber. This produces a closed, gas-filled bounce chamber in the respective power chamber.

The maximum volume of the first compression chamber may be greater than the maximum volume of the first power chamber.

Advantageously, this feature provides a supercharging effect.

The maximum volume of the first compression chamber may be smaller than the maximum volume of the first power chamber.

Advantageously, this feature improves the efficiency of the thermodynamic cycle.

The free-piston internal combustion engine may further comprise an energy conversion device comprising at least one linearly reciprocable element coupled for reciprocation with said compression and power pistons.

BRIEF DESCRIPTION OF THE DRAWINGS

Preferred embodiments of the present invention will now be described, by way of example only and not in any limitative sense, with reference to the accompanying drawings, in which.

DETAILED DESCRIPTION OF EMBODIMENTS

Figure 1:
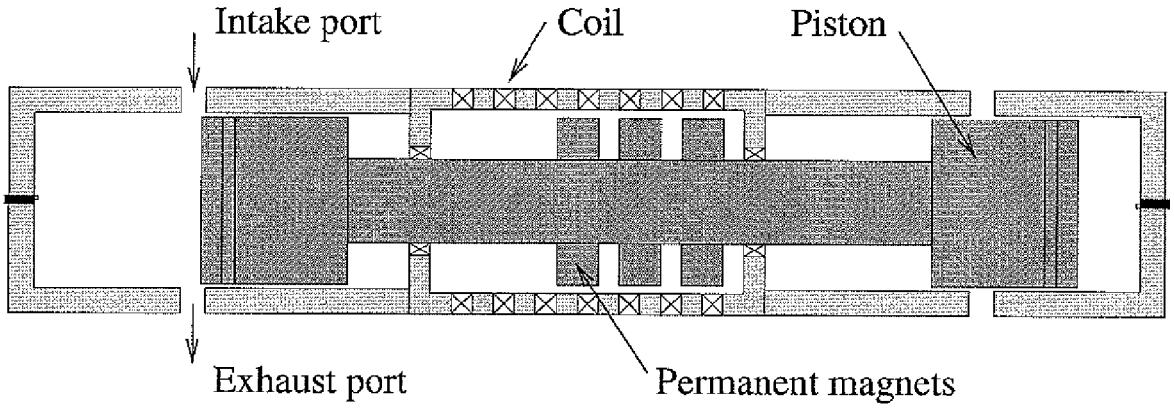
Figure 1 (prior art)
FIG. 1 shows a schematic view of a known dual piston free-piston engine with an integrated linear electric generator.
Figure 2:
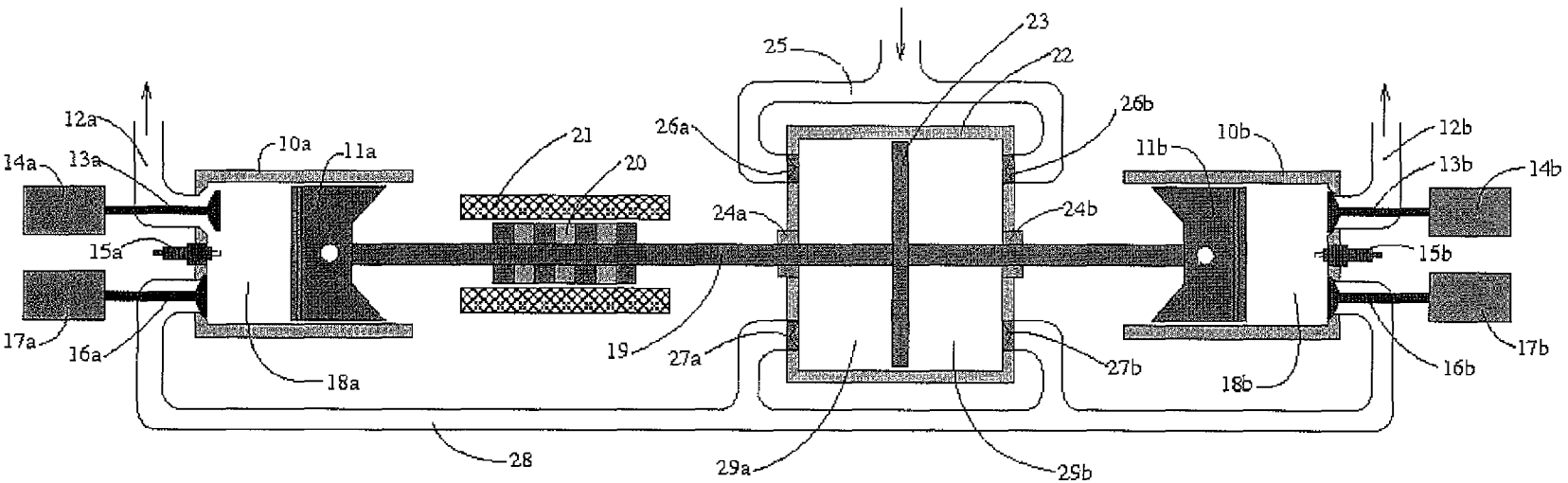
FIG. 2 shows a schematic view of a first embodiment of the invention including dual combustion pistons and a double-acting compressor cylinder.

Referring to FIG. 2, a first embodiment of the free-piston internal combustion engine according to the present invention comprises a first compression chamber 29*a* with a compression piston 23 reciprocable therein, and a first power chamber 18*a* with a first power piston 11*a* reciprocable therein. Conduit means in the form of compressed charge channel 28 enables transfer of the compressed charge from the first compression chamber 29*a* to the first power chamber 18*a*. Valve means, in the form of intake valve 26*a*, outlet valve 27*a*, inlet valve 16*a* and exhaust valve 13*a* control the flow of fluid into and out of the first compression chamber 29*a* and the first power chamber 18*a*. The compression piston 23 and the first power piston 11*a* are rigidly coupled by rod 19 for reciprocation in unison along a common axis defined by the rod 19. During each reciprocation cycle of the compression piston 23 and the first power piston 11*a*, the compression piston 23 performs one intake stroke and one compression stroke of a four-stroke engine cycle in the first compression chamber 29*a*, and the first power piston 11*a* performs one power stroke and one exhaust stroke of the four-stroke engine cycle.

The free-piston internal combustion engine of the first embodiment further includes a second power chamber 18*b* with a second power piston 11*b* reciprocable therein, and a second compression chamber 29*b* in which the compression piston 23 also reciprocates. The compressed charge channel 28 also allows transfer of a compressed charge from second compression chamber 29*b* to first and second power chambers 18*a*, 18*b*, and from first compression chamber 29*a* to second power chamber 18*b*. Valve means, in the form of intake valve 26*b*, outlet valve 27*b*, inlet valve 16*b* and exhaust valve 13*b* control the flow of fluid into and out of the second compression chamber 29*b* and the second power chamber 18*b*. The second power piston 11*b* is also rigidly coupled to the compression piston 23 by the rod 19. The first power piston 11*a*, compression piston 23, second power piston 11*b* and rod 19 form a piston assembly. During each reciprocation cycle of the piston assembly, the compression piston 23 performs one compression stroke and one intake stroke of a four-stroke engine cycle in the second compression chamber 29*b*, and the second power piston 11*b* performs one exhaust stroke and one power stroke of the four-stroke engine cycle.

The first power chamber 18*a* is provided in combustion cylinder 10*a*. Combustion cylinder 10*a* also includes an exhaust port leading to an exhaust channel 12*a*, the exhaust valve 13*a*, a spark plug 15*a*, an inlet port leading to the compressed charge channel 28, and the inlet valve 16*a*. A person skilled in the art will recognise this cylinder design as equivalent to that widely used in commercially available internal combustion engine systems. Exhaust valve 13*a* and inlet valve 16*a* are actuated by means of valve actuation systems 14*a* and 17*a* respectively. The valve actuation systems allow electronic control of the valve opening and closing. Preferably, electro-magnetic actuators are used, however other types such as electro-hydraulic actuators are also suitable.

Similarly, the second power chamber 18*b* is provided in combustion cylinder 10*b*, comprising all other components described in relation to combustion cylinder 10*a*, denoted by the same numerals followed by letter b. Combustion cylinders 10*a* and 10*b* are identical in design, as are all the associated components described above.

In this embodiment, the first and second compression chambers 29*a*, 29*b* are provided in a single compression cylinder 22, which is positioned between combustion cylinders 10*a* and 10*b*. However, the compression chambers 29*a*, 29*b* could be provided in separate cylinders. The rod 19 extends through the ends of compression cylinder 22 supported by bushings 24*a* and 24*b* having appropriate sealing. The compression piston 23 is a dual-acting piston and divides the interior of compression cylinder 22 into the first and second compression chambers 29*a* and 29*b*. In each chamber 29*a* and 29*b*, an intake valve 26*a*, 26*b* permits fluid flow from an intake channel 25 into the respective compression chamber, 29*a*, 29*b*. Intake valves 26*a* and 26*b* are one-way valves (also known as non-return valves or check valves) permitting flow only if the pressure in intake channel 25 is higher than that in the respective compression chamber 29*a*, 29*b*. Similarly, in each compression chamber 29*a* and 29*b*, a one-way outlet valve 27*a*, 27*b* permits flow from the respective compression chamber 29*a*, 29*b*, to compressed charge channel 28. A person skilled in the art will recognise the working principle of the compressor cylinder as similar to that of conventional reciprocating pumps.

By providing the compressed charge channel 28 with a sufficiently high volume and fluid storage capability, the compressed charge channel 28 may be adapted to temporarily store compressed fluid discharged from the first and/or second compression chambers. In this way, the pressure variations in the compressed charge channel 28 during discharge from compression chambers 29*a* and 29*b* will be minimised. Thereby, the pressure as seen by the inlet valves 16*a* and 16*b* will be substantially constant, benefiting the flow of compressed fluid across these valves and into power chambers 18*a* and 18*b*. Although the compression chambers 29*a*, 29*b* preferably supply compressed fluid to a common compressed charge channel 28 as shown in FIGS. 2 and 3, various configurations of direct supply channels may be provided for transferring fluid from the first and/or second compression chambers to the first and/or power chambers 18*a*, 18*b*.

The free-piston engine of the first embodiment also comprises a linear electric machine of conventional configuration, comprising a translator 20 and a stator 21. The translator 20 comprises permanent magnets evenly spaced and separated by spacing material, and is fixed to the rod 19. The stator 21 comprises electrical windings (coils) and is positioned in relation to translator 20 and rod 19.

Figure 3:
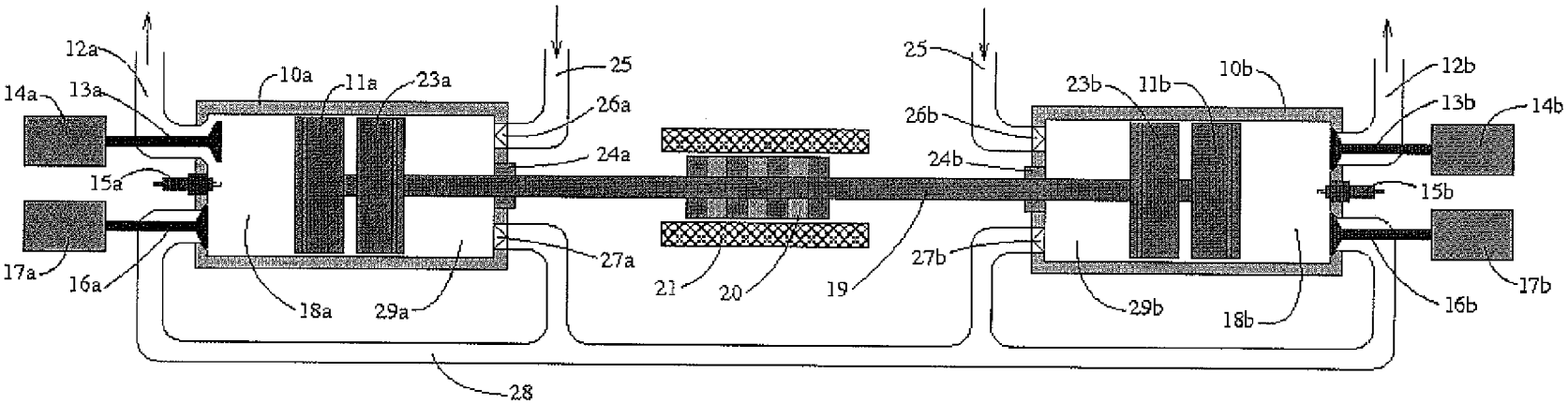
FIG. 3 shows a schematic view of a second embodiment of the invention including dual combustion pistons and in which a compressor cylinder is incorporated into each combustion cylinder.

FIG. 3 shows an alternative embodiment of a free-piston internal combustion engine according to the present invention, in which the first and second compression chambers 29*a*, 29*b*, are incorporated into the first and second combustion cylinders 10*a*, 10*b* respectively. The non-combustion end of each combustion cylinder 10*a*, 10*b* is extended to form a closed compression chamber 29*a*, 29*b*. One-way intake valves 26*a*, 26*b* and outlet valves 27*a*, and 27*b* are implemented similarly as described above. The rod 19 extends through the compression end of cylinders 10*a* and 10*b* supported by bushings 24*a* and 24*b*.

Although the embodiments described above utilise spark ignition, a person skilled in the art will appreciate that the engine of the present invention is equally well suited to compression ignition operation, including both conventional diesel engine operation and homogeneous charge compression ignition.

Engine Operation

A standard four-stroke combustion engine cycle consists of four processes: an intake stroke, wherein a fuel-air mixture enters the cylinder; a compression stroke, wherein the fuel-air mixture is compressed, typically to a volume less than one tenth of the start-of-compression volume; a power expansion stroke, wherein the compressed fuel-air mixture is ignited, a rapid combustion occurs, and the resulting high-pressure combustion products are expanded to approximately the fuel-air mixture start-of-compression volume; and an exhaust stroke, wherein the expanded combustion products are expelled from the cylinder. In a conventional internal combustion engine, these processes are performed successively in each cylinder with one engine cycle requiring two full engine revolutions, or four strokes.

Referring to FIG. 2, the operation of the free-piston internal combustion engine according to the first embodiment of the present invention can be described as follows. The piston assembly consists of power pistons 11*a* and 11*b*, translator 20, rod 19, and compression piston 23. The piston assembly is free to reciprocate linearly, its motion being determined by the instantaneous sum of forces acting upon it, i.e. the gas pressure forces acting on power pistons 11*a* and 11*b*, the electromagnetic force acting on translator 20, and the gas pressure forces acting on compression piston 23. The outer mechanical limits (endpoints) of the piston assembly motion are defined by the combustion cylinders 10*a* and 10*b* and the compression cylinder 22.

Consider the piston assembly moving towards the left hand side endpoint. During the right-to-left motion, the first power chamber 18*a* performs an exhaust stroke, wherein exhaust valve 13*a* is open and combustion products from power chamber 18*a* are discharged to exhaust channel 12*a* by piston 11*a*. The first compression chamber 29*a* in compression cylinder 22 performs a compression stroke, wherein a combustible mixture previously admitted from intake channel 25 is compressed. During this stroke, the pressure in the first compression chamber 29*a* increases until it exceeds that of compressed charge channel 28, such that outlet valve 27*a* opens and the mixture is discharged into compressed charge channel 28. At the same time, the second compression chamber 29*b* performs an intake stroke: as the compression piston 23 travels leftwards, the pressure in the second compression chamber 29*b* drops below that in intake channel 25, causing intake valve 26*b* to open and combustible mixture to flow from intake channel 25 into the second compression chamber 29*b*. The second power chamber 18*b* performs a power expansion stroke, wherein combustible mixture has been ignited and the high-pressure combustion products are expanded in the closed cylinder as the second power piston 11*b* travels towards the left hand side.

As the piston assembly approaches its left hand side endpoint, the exhaust stroke in combustion cylinder 10*a* finishes and exhaust valve 13*a* is closed. Inlet valve 16*a* is subsequently opened for a short period while the piston assembly is around its left hand side endpoint. The short opening of inlet valve 16*a* permits pressurised combustible mixture to flow rapidly from compressed charge channel 28 into the first power chamber 18*a*, making combustion cylinder 10*a* instantly ready to perform a power expansion stroke. Subsequent ignition and the following rapid pressure increase in the first power chamber 18*a* accelerate the piston assembly towards the right hand side and during the resulting left-to-right stroke the first power chamber 18*a* performs a power expansion stroke.

During the left-to-right motion, mixture is admitted from intake channel 25 into the first compression chamber 29*a* through intake valve 26*a*, similarly as described above. The mixture previously admitted into the second compression chamber 29*b* is compressed and subsequently discharged into the compressed charge channel 28 through outlet valve 27*b*. An exhaust stroke in power chamber 18*b* with exhaust valve 13*b* open rejects the combustion products from the previous power stroke into exhaust channel 12*b*. As the piston assembly approaches its right hand side endpoint, exhaust valve 13*b* closes and a short opening of inlet valve 16*b* fills the second power chamber 18*b* with compressed combustible mixture. The ignition of the mixture starts the power expansion stroke in the second power chamber 18*b*, which drives the piston assembly back towards the left hand side, as described above. This completes one full engine cycle.

During the reciprocating motion of the piston assembly, the magnetic field produced by the magnets of translator 20 induces an electrical voltage in the coils of stator 21. The net work output from the engine cycle can thereby be utilised as electric energy.

Design Considerations

The the combustion cylinders 10*a*, 10*b* and associated components will only require minor design modifications compared with those known from conventional four-stroke engine technology, which will be well known to those skilled in the art. Major design variables such as cylinder bore, stroke length, compression ratio, and power chamber design have similar influence on engine performance as that known in the art. Advantageously, the design of inlet valves 16*a* and 16*b* is adapted to accommodate efficient intake of compressed fluid over a short time period.

Preferably, the compression cylinder 22 and piston 23 are made of a light-weight material and care is taken to minimise frictional losses and gas flow losses over the intake valves 26*a*, 26*b* and outlet valves 27*a*, 27*b*. A major advantage of the current design over conventional engines, in which the combustion cylinder also performs both the power stroke and the compression stroke, is that the compression cylinder can be designed independently of the combustion cylinder. Thus the compression cylinder can be designed specifically for its purpose. Since the compression piston 23 works against lower pressure levels than the power pistons 11*a*, 11*b*, sealing requirements are somewhat relaxed, reducing frictional losses. Moreover, the gas temperature in the compression cylinder 22 is significantly lower than that in the combustion cylinders 10*a*, 10*b*, which may allow the use of solid film lubrication.

The size of the compression cylinder 22 in relation to the power cylinders 10*a*, 10*b* is an important design variable in the engine system. By varying the ratio between these cylinders, the operational characteristics of the engine can be adjusted and the design optimised for a given application. This is a major advantage compared to conventional engines, in which this ratio is fixed since all four engine strokes are performed by one chamber. Using a compressor cylinder 22 with approximately the same swept volume as the power cylinders 10*a*, 10*b* gives a thermodynamic cycle comparable to that obtained in conventional internal combustion engines. By designing the compressor cylinder 22 with a swept volume larger than that of the power cylinders 10*a*, 10*b*, a supercharging effect is obtained. Conversely, using a compressor cylinder 22 swept volume lower than the power cylinder 10*a*, 10*b* swept volumes gives an over-expanded cycle, i.e. an expansion ratio higher than the compression ratio. This is known as a Miller or Atkinson cycle, and is widely known to improve cycle efficiency. Hence, the free-piston internal combustion engine of the present invention gives significant freedom in the design of the engine, allowing it, for example, to be tailored to a specific application and optimised for operation on a specific fuel.

In the embodiments described above, a permanent magnet electric machine is employed. However, depending on the application, other types of electric machine topology, for example moving coil designs, may be more suitable. Other types of linear-acting energy conversion devices, such as a hydraulic or pneumatic compressor, can equally well be used.

Operational Control

As described above, engine control issues have previously been reported as the main challenge to the widespread application of free-piston engines. Because the piston motion is not restricted by a crankshaft, the left hand side and right hand side endpoints in each cycle depend on the kinetic energy of the piston assembly. During each stroke, energy is added by the power stroke and consumed by the compression stroke and by driving the electric machine. Rapid load changes influence the kinetic energy of the piston assembly and will, if sufficiently large, lead to deviations from the nominal endpoint positions.

The opening and closing of inlet valves 16*a* and 16*b* determine the amount of intake mixture admitted into power chambers 18*a* and 18*b* in each cycle. By reducing the opening period of the inlet valve 16*a*, 16*b*, the amount of fresh charge admitted to the power chamber 18*a*, 18*b* is reduced, leading to a lower energy production in the following power stroke. If a higher energy output is required, the intake process can be carried out prior to the power piston 11*a*, 11*b* reaching its endpoint, thereby allowing a larger volume of fresh charge to be admitted into the power chamber 18*a*, 18*b*.

A change in engine load and/or the kinetic energy of the piston assembly can be identified using sensors measuring, for example, electric load output or piston assembly position, speed or acceleration. Advantageously, upon identifying a load change, the timing of the inlet valves 16*a*, 16*b* can be adjusted in this manner to rapidly adjust the work output of the power expansion stroke, thereby helping to maintain stable engine operation. This is a major advantage compared with prior art engines, in which there is a significant time delay between a load change occurring and corrective action being taken.

Moreover, in the case of a very large load decrease the piston assembly may obtain a kinetic energy significantly higher than that desired. This may give a large deviation from the nominal piston assembly endpoints, and there may be a risk of mechanical contact between the piston and cylinder head. If such a risk is identified, the closing of the exhaust valve 13*a*, 13*b* can be advanced and the opening of the inlet valve 16*a*, 16*b* delayed, such as to produce a closed, gas-filled bounce chamber in the respective power chamber 18*a*, 18*b*. This effectively acts as a gas spring, ensuring that mechanical contact between the power piston 11*a*, 11*b* and cylinder head is avoided. As the kinetic energy of the piston assembly reaches a non-critical value, intake mixture can be admitted into the power chamber 18*a*, 18*b* and normal operation resumed.

It will be appreciated by persons skilled in the art that the above embodiments have been described by way of example only, and not in any limitative sense, and that various alterations and modifications are possible without departure from the scope of the invention as defined by the appended claims.

The invention claimed is:

1. A free-piston internal combustion engine comprising:

a first compression chamber;

a first compression piston reciprocable in the first compression chamber;

a first power chamber;

a first power piston reciprocable in the first power chamber;

at least one conduit device for conducting fluid from the first compression chamber to the first power chamber; and at least one valve device for controlling the flow of fluid into and out of the first compression chamber and the first power chamber;

wherein the first compression piston and the first power piston are rigidly coupled for reciprocation in unison;

wherein the first compression chamber, first power chamber and at least one said valve device are configured such that during each reciprocation cycle of said first compression and power pistons:

the first compression piston performs one intake stroke and one compression stroke of a four-stroke engine cycle, and the first power piston performs one power stroke and one exhaust stroke of the four-stroke engine cycle; and wherein at least one said valve device is configured such that compressed fluid discharged from said first compression chamber is delivered from at least one said conduit device to the first power chamber between an exhaust stroke and a following power stroke of the first power piston.

2. A free-piston internal combustion engine according to claim 1, further comprising:

a second compression chamber a second compression piston reciprocable in the second compression chamber;

a second power chamber; and a second power piston reciprocable in the second power chamber;

wherein at least one said conduit device is further adapted for conducting fluid from the second compression chamber to the second power chamber and/or the first power chamber; and wherein at least one said valve device is further adapted for controlling the flow of fluid into and out of the second compression chamber and the second power chamber;

wherein the second compression piston and the second power piston are rigidly coupled for reciprocation in unison with the first compression piston and the first power piston;

wherein the second compression chamber, second power chamber and at least one said valve device are configured such that during each reciprocation cycle of said second compression and power pistons:

the second compression piston performs one compression stroke and one intake stroke of a four-stroke engine cycle, and the second power piston performs one exhaust stroke and one power stroke of the four-stroke engine cycle.

3. A free-piston internal combustion engine according to claim 2, wherein the first and second compression chambers are provided in a single compression cylinder, and said first and second compression pistons are provided by a double-acting compression piston reciprocable in said compression cylinder.

4. A free-piston internal combustion engine according to claim 2, wherein the first power chamber and second compression chamber are provided in a first cylinder, said first power piston and second compression piston being provided by a first double-acting piston reciprocable in said first cylinder; and the second power chamber and first compression chamber are provided in a second cylinder, said second power piston and first compression piston being provided by a second double-acting piston reciprocable in said second cylinder.

5. A free-piston internal combustion engine according to claim 2, wherein at least one said conduit device is adapted for conducting fluid from the first and second compression chambers to the first and second power chambers.

6. A free-piston internal combustion engine according to claim 1, wherein at least one said conduit device is further adapted to temporarily store compressed fluid discharged from the first and/or second compression chamber.

7. A free-piston internal combustion engine according to claim 1, further comprising an electronic controller for controlling at least one said valve device.

8. A free-piston internal combustion engine according to claim 7, wherein said electronic controller is adapted to control an amount of power produced in said power stroke by adjusting an amount of fluid admitted into the power chamber by at least one said valve device.

9. A free-piston internal combustion engine according to claim 7 wherein said electronic controller is adapted to adjust the timing of at least one said valve device when an increase in kinetic energy of the compression and power pistons, sufficient for them to travel past a predefined end point, is present.

10. A free-piston internal combustion engine according to claim 1, wherein the maximum volume of said first compression chamber is greater than the maximum volume of said first power chamber.

11. A free-piston internal combustion engine according to claim 1, wherein the maximum volume of said first compression chamber is smaller than the maximum volume of said first power chamber.

12. A free-piston internal combustion engine according to claim 1, further comprising an energy conversion device comprising at least one linearly reciprocable element coupled for reciprocation with said compression and power pistons.

13. A free-piston internal combustion engine according to claim 1, wherein:

during said intake stroke performed by said first compression piston, fluid enters said first compression chamber;

during said compression stroke performed by said first compression piston, fluid in said first compression chamber is compressed;

during said power stroke performed by said first power piston, fluid in said first power chamber is expanded; and during said exhaust stroked performed by said first power piston, fluid is discharged from said first power chamber by the first power piston.

14. A free-piston internal combustion engine according to claim 2, wherein:

during said compression stroke performed by said second compression piston, fluid in said second compression chamber is compressed;

during said intake stroke performed by said second compression piston, fluid enters said second compression chamber;

during said exhaust stroke performed by said second power piston, fluid is discharged from said second power chamber by the second power piston; and during said power stroked performed by said second power piston, fluid in said second power chamber is expanded.

15. A free-piston internal combustion engine comprising:

a first compression chamber;

a first compression piston reciprocable in the first compression chamber;

a first power chamber;

a first power piston reciprocable in the first power chamber;

at least one conduit device for conducting fluid from the first compression chamber to the first power chamber; and at least one valve device for controlling the flow of fluid into and out of the first compression chamber and the first power chamber;

wherein the first compression piston and the first power piston are rigidly coupled for reciprocation in unison;

wherein the first compression chamber, first power chamber and at least one said valve device are configured such that during each reciprocation cycle of said first compression and power pistons;

the first compression piston performs one intake stroke and one compression stroke of a four-stroke engine cycle, and the first power piston performs one power stroke and one exhaust stroke of the four-stroke engine cycle; and wherein said at least one valve device includes:

at least one first exhaust valve device for controlling the flow of fluid out of the first power chamber, and at least one first inlet valve device for controlling the flow of fluid into the first power chamber; and wherein, over a majority of said exhaust stroke performed by said first power piston, said first exhaust valve device is open to allow fluid to flow out of the first power chamber and said first inlet valve device is closed to prevent fluid from entering said first power chamber.

16. A free-piston internal combustion engine according to claim 2, wherein said at least one valve device includes:

at least one second exhaust valve device for controlling the flow of fluid out of the second power chamber, and at least one second inlet valve device for controlling the flow of fluid into the second power chamber; and wherein, over a majority of said exhaust stroke performed by said second power piston, said second exhaust valve device is open to allow fluid to flow out of the second power chamber and said second inlet valve device is closed to prevent fluid from entering said second power chamber.

17. A free-piston internal combustion engine according to claim 2, wherein at least one said valve device is configured such that compressed fluid discharged from said second compression chamber is delivered from at least one said conduit device to the second power chamber between an exhaust stroke and a following power stroke of the second power piston.

18. A free-piston internal combustion engine according to claim 15, further comprising an electronic controller for controlling at least one said valve device.

19. A free-piston internal combustion engine according to claim 15, further comprising an energy conversion device comprising at least one linearly reciprocable element coupled for reciprocation with said compression and power pistons.

* * * * *